United States Patent [19]

Frusha et al.

[11] Patent Number: 4,894,757

[45] Date of Patent: Jan. 16, 1990

[54] ILLUMINATION APPARATUS FOR ORNAMENTS

[76] Inventors: John D. Frusha, 12539 N. Oakhills Parkway, Baton Rouge, La. 70810; Sam S. Lee, 12F., Tun HWA S. Rd., Taipei, Taiwan

[21] Appl. No.: 235,025

[22] Filed: Aug. 22, 1988

[51] Int. Cl.[4] ..... F21L 15/08

[52] U.S. Cl. ..... 362/104; 362/103; 362/184; 63/1.1; 63/3

[58] Field of Search ..... 362/104, 103, 184, 191, 362/238, 363, 806, 203, 252, 236, 237, 253, 375, 458; 63/1.1, 3

[56] References Cited

U.S. PATENT DOCUMENTS

| | | | |
|---|---|---|---|
| 4,170,036 | 10/1979 | Sussel | 362/104 |
| 4,296,459 | 10/1981 | DeLuca | 362/104 |
| 4,438,482 | 3/1984 | Leon et al. | 362/184 |
| 4,459,645 | 7/1984 | Glatter | 362/104 |
| 4,577,263 | 3/1986 | Maglica | 362/187 |
| 4,748,544 | 5/1988 | Ince | 362/203 |
| 4,777,408 | 10/1988 | DeLuca | 362/104 |
| 4,779,172 | 10/1988 | Jimenez et al. | 362/806 |

*Primary Examiner*—Ira S. Lazarus
*Assistant Examiner*—Richard R. Cole
*Attorney, Agent, or Firm*—Fitch, Even, Tabin & Flannery

[57] ABSTRACT

The present invention provides an illuminating apparatus for ornamental elements such as in an illuminated necklace, an illuminated belt or the like, which includes a plurality of lamps to illuminate more than one lamp housing which simulates a pendant or the like. A battery assembly is provided in one of the lamp housings to power the circuit of the illuminating apparatus.

10 Claims, 4 Drawing Sheets

ILLUMINATION APPARATUS FOR ORNAMENTS

BACKGROUND OF THE INVENTION

This invention relates to an illuminated ornament such as a necklace, a belt or the like, particularly to an illumination apparatus for the purpose of illuminating an ornamental element such as a pendant of a necklace, a belt buckle or the like.

The technology to provide illuminating light bulbs in ornamental elements such as earrings, necklaces, belt buckles or the like to increase the brightness of the elements is known in the art. Examples of these ornamental elements are disclosed in U.S. Pat. Nos. 4,262,324, 3,624,384 and 4,605,882.

U.S. Pat. No. 4,262,324 discloses an ornamental article of neckwear which includes a pendant incorporating a lamp, an elongated casing carrying a dry cell, and an elongated flexible looped conductor electrically interconnecting the elongated casing and the lamp of the pendant to form a ring member. In this article, the casing holding the dry cell is separated from the housing holding the lamp.

SUMMARY OF THE INVENTION

The present invention provides an illuminating apparatus for ornamental elements such as a necklace, a belt or the like which includes a plurality of lamps to illuminate more than one lamp housing which simulates a pendant or the like. A battery assembly is provided in one of the lamp housings to power the circuit of the illuminating apparatus.

Unlike the neckware disclosed in U.S. Pat. No. 4,262,324, the illuminating apparatus according to the present invention is arranged in such a manner that the dry cells can be placed in a housing which encases a lamp.

The exemplary preferred embodiment will be described in detail with reference to the accompanying drawings, in which:

DETAILED DESCRIPTION OF THE PREFERRED EMBODIMENT

Figure 1:
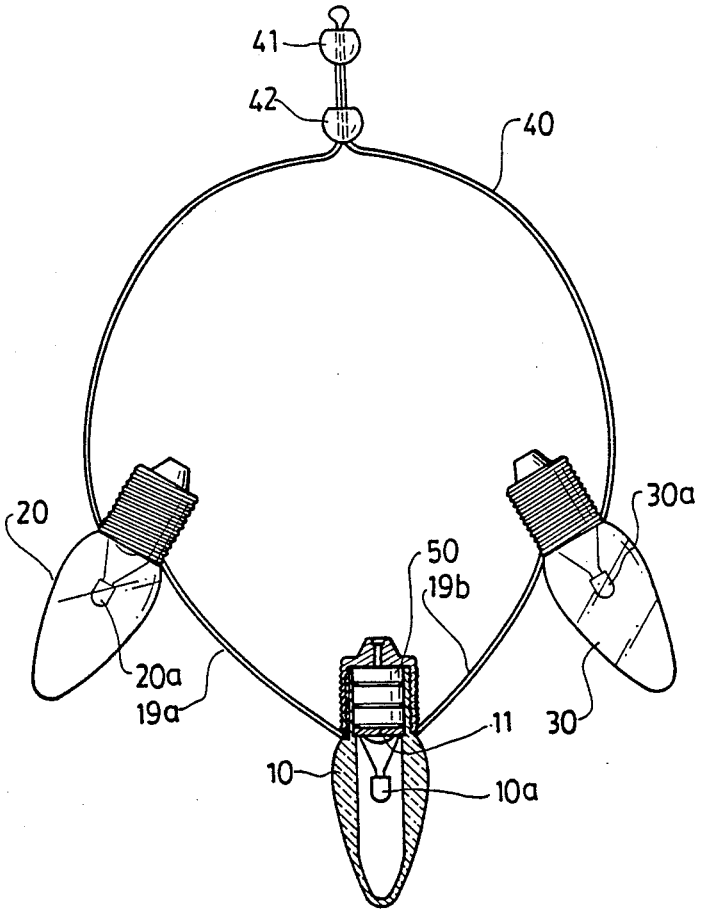
FIG. 1 shows an illumination apparatus according to the present invention.
Figure 2:
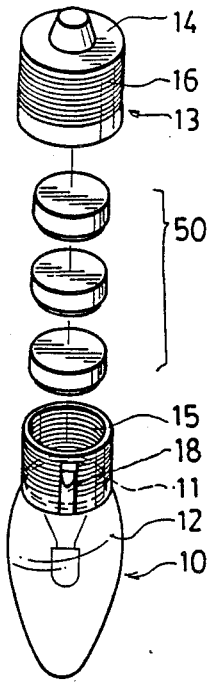
FIG. 2 is an exploded view of one of the lamp housings incorporating the batteries and a lamp.

Referring to FIGS. 1 and 2, an illumination apparatus for use in illuminating an ornamental article such as a necklace, a belt or the like according to the present invention is shown, including three housings 10, 20 and 30 which are interconnected by an elongated flexible member 40 such as a nonconductive cord 40 which is provided with a decorative coating. Fasteners 41 and 42 are attached to the cord 40 for fastening the ends of the cord together. Although the housings 10, 20, and 30 are in the shape of a light buib, they can be manufactured in the form of any other decorative shapes such as different shapes of necklace pendants. The housing 10 has a threaded tubular neck portion 15 in which is mounted a printed circuit board 11. A lamp 10a is mounted on and electrically connected to the printed circuit board 11. The neck portion 15 defines a chamber above the board 11 for receiving three batteries 50. The positive terminal of the battery assembly will contact electrically with terminal $V_{DD}$ of the printed circuit board when the batteries 50 are placed in the chamber of the neck portion 15.

A conductive spring plate 18 is mounted on the wall of the threaded neck portion 15 and connected to the printed circuit board 11. A conductive cap 13 with a screw thread 16 is provided around the neck portion 15 and is in contact with the conductive spring plate 18. The cap 13 has a back member 14 adapted to contact the negative terminal of the assembly of the batteries 50 to the terminal $V_{SS}$ of the printed circuit board when the cap is turned. The cap 13 can be used for the switching operation of the circuit of the illumination apparatus.

Figure 3:
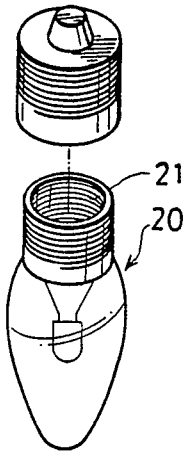
FIG. 3 is an exploded view of another lamp housing of the illumination apparatus.
Figure 6:
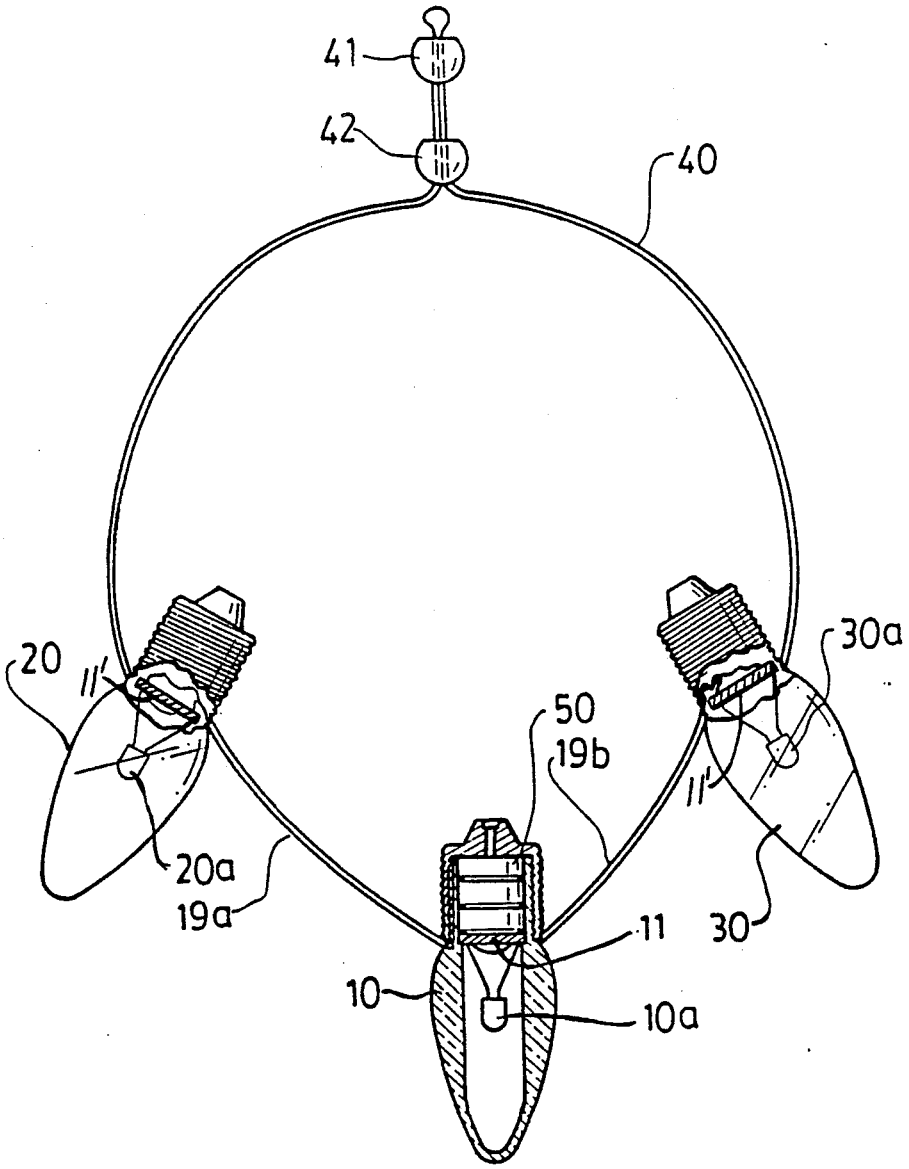
FIG. 6 shows the apparatus of FIG. 1 in greater detail.

As shown in FIG. 3, the housing 20 has a neck portion defining a chamber 21. The construction of the housing 20 is substantially similar to that of the housing 10 except that no spring plate 18 is provided therein. The chamber 21 of the housing 20 can be used for holding replacement batteries. The housing 30 is identical to the housing 20. Referring to FIGS. 1 and 6, conductors in the form of metal filaments (not shown) are provided in the cord 40 for electrically interconnecting the lamps **10*a*, 20*a* and 30*a* of the housings 10, 20, and 30. The metal filaments, which are connected to the printed circuit board 11 in housing 10 and to the three lamps 10*a*, 20*a* and 30*a* in housings 10, 20, and 30, extend in portions 19*a* and 19*b* of the cord 40 As will be seen below, the printed circuit board in housing 10 includes an oscillator, whereas the printed circuit boards 11' in housings 20 and 30 are provided for convenient electrical connection to lamps 20*a*, 30*a***.

Figure 4:
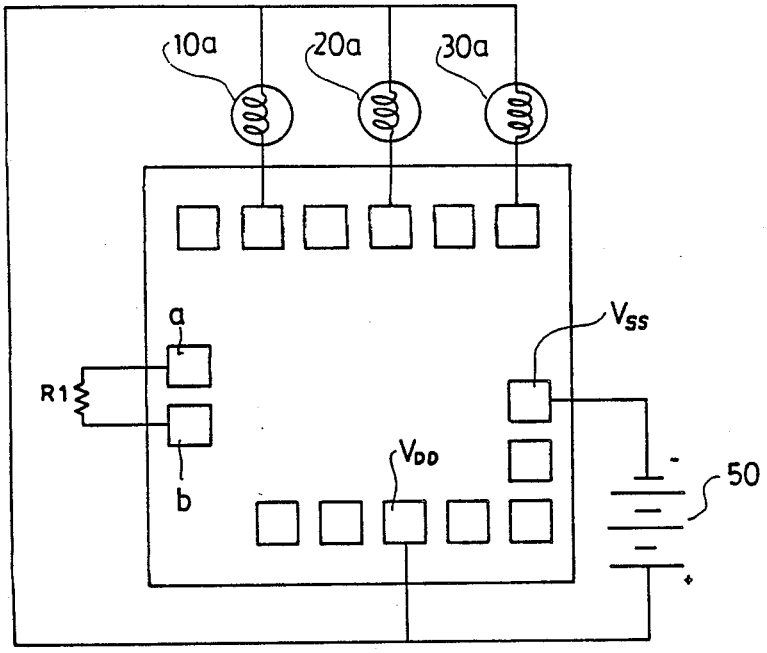
FIG. 4 shows schematically a printed circuit board in connection with the lamps and the batteries.

FIG. 4 illustrates schematically the electrical connection between the printed circuit 11 of the housing 10 and the other elements of the illumination apparatus. The lamp **10*a*, 20*a* and 30*a* are in parallel connection with one another and also connected to the batteries 50 in housing 10. The circuit board of the illumination apparatus includes an oscillator (not shown) connected via terminals a, b to a resistor R, so as to control the flickering of the interconnected lamps 10*a*, 20*a* and 30*a*. The circuit can be placed in an ON position by turning the cap 13 to move the back member 14** to contract with the negative terminal of the battery assembly. Since the circuit of the illumination apparatus is known in the art, the detail thereof will not be described herein.

Figure 5:
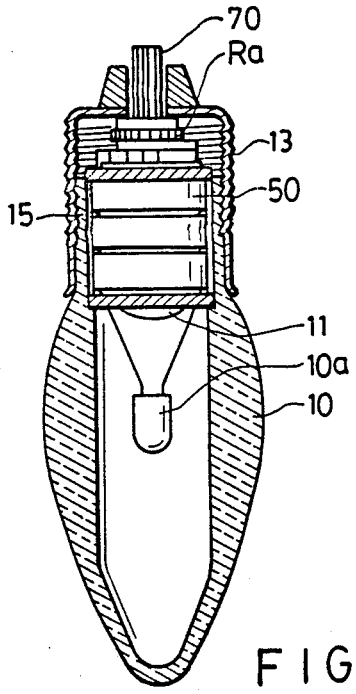
FIG. 5 shows the lamp housing of FIG. 2 which is provided with a variable resistor and a rotatable knob.

Referring to FIG. 5, an alternative embodiment of the invention is shown, wherein the neck portion 15 of the lamp housing 10 is provided with a variable resistor Ra instead of the resistor R1. A rotatable knob 70 is mounted on the back of cap 13 to operate the resistor Ra.

FIG. 6 is similar to FIG. 1, but shows the printed circuit boards 11' in housings 20, 30. The printed circuit boards 11' provide a convenient mounting and electrical connection for lamps **20*a*, 30*a***.

With the invention thus explained, it is apparatus that numerous modifications and variations can be made without departing from the scope of the invention. It is therefore intended that the invention be limited as only indicated in the appended claims.

What I claim is:

1. An illumination apparatus, comprising:

a plurality of lamps;

a plurality of housings each encasing at least one of said lamps;

at least one of said housings having a tubular neck portion with a threaded wall;

a printed circuit board mounted in said tubular neck portion for electrical connection to at least one said lamp;

at least one battery means provided in said neck portion, with means for electrical connection to said printed circuit board;

a cap enclosing said neck portion and including switch means for switching the electrical power of said battery to said printed circuit board; and electrical connecting means for electrically connecting said printed circuit board to the other of said lamps.

2. The apparatus according to claim 1 wherein said electrical connecting means comprise a metal filament disposed within a flexible insulator member interconnecting said housings.

3. The apparatus of claim 1 wherein the printed circuit board of said one housing includes an oscillator to control the flickering of said lamps.

4. The apparatus of claim 3 wherein the printed circuit boards of housing other than said one housing comprise conductor means for electrically connecting a lamp associated therewith to said conductor means which electrically connecting said printed circuit boards.

5. An illumination apparatus for an ornament such as a necklace, a belt buckle or the like comprising:

a plurality of lamps, a plurality of housings each encasing each of said lamps, said housing being adapted to simulate an ornamental element, each of said housings having a tubular neck portion with a threaded wall, a printed circuit board mounted in said neck portion of each of said housings and connected electrically to each of said lamps, a conductive spring plate mounted on said threaded wall of one of said housings and connected electrically to said printed circuit board of said one housing, a dry cell provided in said neck portion of said one housing and having a first terminal to be connected electrically to said printed circuit board of said one housing, a conductive cap threadedly provided around said neck portion of said one housing, said cap being in contact with said spring plate, said cap having a back member which will come into contact with a second terminal of said dry cell upon turning said cap, conductor means for connecting electrically said printed circuit board in said one housing to said printed circuit boards of other said housings, and an elongated flexible member interconnecting said housings, said flexible member covering said conductor means.

6. An illumination apparatus as claimed in claim 5, wherein said conductor means is a metal filament.

7. An illumination apparatus as claimed in claim 5, further comprising a variable resistor provided in said one housing and a rotary knob mounted on said cap of said one housing for controlling said variable resistor.

8. An illumination apparatus comprising:

a plurality of lamps;

a plurality of housings encasing said lamps;

at least one of said housings having a tubular neck portion;

a printed circuit board mounted in said neck portion and including oscillator means for controlling the flickering of a lamp electrically connected thereto;

printed circuit boards in said housings other than said one housing, electrically connected to the lamps therein;

battery means in said neck portion to provide electrical power to said circuit board;

a cap enclosing said neck portion and including switch means for switching the electrical power of said battery to said printed circuit board; and conductive means for electrically connecting said printed circuit board to said lamps.

9. The apparatus according to claim 8 wherein the tubular neck portion of said one housing includes a threaded wall and said cap enclosing said housing is made of conductive material and is threaded for mating with said wall, said apparatus further comprising a conductive spring plate mounted on said threaded wall and electrically connected to said printed circuit board for the energization thereof from said battery, said conductive cap being movable into an out of engagement with said spring plate so as to make and break the electrical circuit between said battery and said printed circuit board.

10. The apparatus of claim 9 further comprising a variable resistor electrically connected to said printed circuit board and a rotary knob in said one housing for controlling said variable resistor.

* * * * *

UNITED STATES PATENT AND TRADEMARK OFFICE

CERTIFICATE OF CORRECTION

PATENT NO. : 4,894,757

DATED : January 16, 1990

INVENTOR(S) : Frusha et al.

It is certified that error appears in the above-identified patent and that said Letters Patent is hereby corrected as shown below:

On the Face of the Patent, under [76] Inventors:, line 3, change "Tun HWA" to --603 TUN HWA--.

Column 1, line 68, change "buib" to --bulb--.

Column 2, line 36, after "40" insert --.-- (period).

Column 2, line 44, change "lamp" to --lamps--.

Column 2, line 51, change "contract" to --contact--.

Column 2, line 66, change "apparatus" to --apparent--.

Signed and Sealed this

Eighteenth Day of December, 1990

*Attest:*

HARRY F. MANBECK, JR.

*Attesting Officer*

*Commissioner of Patents and Trademarks*